US009198836B1

(12) United States Patent
Akinyelure

(10) Patent No.: US 9,198,836 B1
(45) Date of Patent: Dec. 1, 2015

(54) PACIFIER WITH RETRACTABLE NIPPLE

(71) Applicant: Olubimpe Akinyelure, Baltimore, MD (US)

(72) Inventor: Olubimpe Akinyelure, Baltimore, MD (US)

( * ) Notice: Subject to any disclaimer, the term of this patent is extended or adjusted under 35 U.S.C. 154(b) by 288 days.

(21) Appl. No.: 13/920,262

(22) Filed: Jun. 18, 2013

(51) Int. Cl.
*A61J 17/00* (2006.01)

(52) U.S. Cl.
CPC ..... *A61J 17/00* (2013.01)

(58) Field of Classification Search
CPC ..... A61J 17/00; A61J 17/02; A61J 2017/001; A61J 11/00; A61J 13/00
USPC ..... 606/234, 236
See application file for complete search history.

(56) References Cited

U.S. PATENT DOCUMENTS

| | | | | |
|---|---|---|---|---|
| 3,129,709 | A | 4/1964 | Rountree | |
| 3,924,621 | A * | 12/1975 | Cassimally | 606/236 |
| 4,329,996 | A | 5/1982 | Copeland | |
| 4,878,496 | A | 11/1989 | Chen | |
| 2012/0330358 | A1 * | 12/2012 | Ahern | 606/234 |

* cited by examiner

*Primary Examiner* — Victor Nguyen
(74) *Attorney, Agent, or Firm* — Crossley Patent Law

(57) ABSTRACT

A pacifier with retractable nipple that includes a pacifier nipple alternately extendible from, and retractable within, a cup member concavity, wherein said pacifier nipple is more expediently presented to, and alternately removed from, a suckling child, said pacifier with retractable nipple thereby storable with said pacifer nipple disposed within said cup member concavity, there removed from contact with extant objects or surfaces during storage between uses, whereby likelihood of contamination to the pacifier nipple is lessened.

2 Claims, 4 Drawing Sheets

PACIFIER WITH RETRACTABLE NIPPLE

BACKGROUND OF THE INVENTION

Various types of pacifier with retractable nipples are known in the prior art. However, what is needed is a pacifier with retractable nipple that includes a pacifier nipple alternately extendible from, and retractable within, a cup member concavity, wherein said pacifier nipple is more expediently presented to, and alternately removed from, a suckling child, said pacifier with retractable nipple thereby storable with said pacifer nipple disposed within said cup member concavity, there removed from contact with extant objects or surfaces during storage between uses, whereby likelihood of contamination to the pacifier nipple is lessened.

FIELD OF THE INVENTION

The present invention relates to a pacifier with retractable nipple, and more particularly, to a pacifier with retractable nipple that includes a pacifier nipple alternately extendible from, and retractable within, a cup member concavity, wherein said pacifier nipple is more expediently presented to, and alternately removed from, a suckling child, said pacifier with retractable nipple thereby storable with said pacifer nipple disposed within said cup member concavity, there removed from contact with extant objects or surfaces during storage between uses, whereby likelihood of contamination to the pacifier nipple is lessened.

SUMMARY OF THE INVENTION

The general purpose of the pacifier with retractable nipple, described subsequently in greater detail, is to provide a pacifier with retractable nipple which has many novel features that result in a pacifier with retractable nipple which is not anticipated, rendered obvious, suggested, or even implied by prior art, either alone or in combination thereof.

The present pacifier with retractable nipple has been devised to enable storage of a pacifier nipple retracted within a cup member concavity whereby said pacifier nipple is protected from contamination from the external environment between uses. Furthermore, the present invention enables the expedient presentation of the pacifier nipple to a suckling child, and expedient removal of said pacifier nipple therefrom, when desired.

The present invention, therefore, includes a cup member including a concavity having an apex and a rim. A winged periphery is disposed extended from around the rim, said winged periphery configured to present a surface to abut the face of a user suckling the pacifier with retractable nipple proximal and surrounding said user's mouth.

An aperture is disposed in the apex of the cup member concavity and a shaft member is slidably disposed therethrough. The shaft member includes a first end and a second end and is moveable between an extended position and a retracted position, whereby a pacifier nipple is alternately extended and retraced from within the cup member concavity, as will be described subsequently.

The pacifier nipple is disposed endwise upon the first end of the shaft member. When the shaft member is moved to the extended position, the pacifier nipple is extended from the cup member and presented for suckling. When the shaft member is moved to the retracted position, the pacifier nipple is moved within the cup member concavity and stored away from the ambient environment wherein said pacifier with retractable nipple may be placed between uses. Moreover, retraction of the pacifier nipple renders removal of the pacifier with retractable nipple from a suckling child more expedient.

To prevent overextension of the shaft member when moved to the extended position, and potential injury to a child thereby, a discoid stopper member is circumferentially disposed around the shaft member proximal the second end. When the shaft member is moved to the extended position, the stopper member thusly abuts the apex of the cup member concavity and prevents overextension of the pacifier nipple. A lip member disposed upon the shaft member more proximal the first end prevents overextension of the shaft member when moved to the retracted position.

To enable manipulation and wielding of the shaft member between said extended and retracted positions, a ring member is disposed in the shaft member second end. The ring member is thus graspable, and the shaft member may thereby be retracted and extended, as desired, with relative ease.

Thus has been broadly outlined the more important features of the present pacifier with retractable nipple so that the detailed description thereof that follows may be better understood and in order that the present contribution to the art may be better appreciated.

Objects of the present pacifier with retractable nipple, along with various novel features that characterize the invention are particularly pointed out in the claims forming a part of this disclosure. For better understanding of the pacifier with retractable nipple, its operating advantages and specific objects attained by its uses, refer to the accompanying drawings and description.

BRIEF DESCRIPTION OF THE DRAWINGS

Figures

Figure 1:
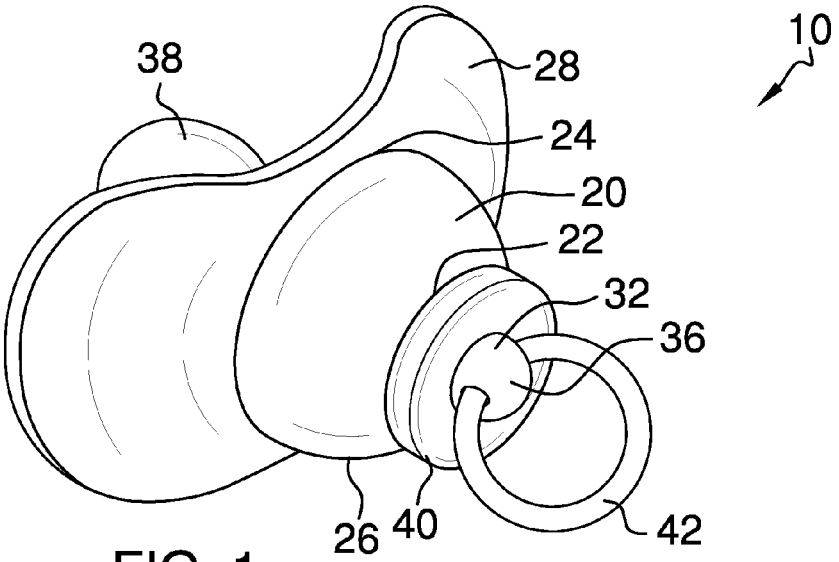
FIG. 1 is an isometric view illustrating a shaft member in an extended position.
Figure 2:
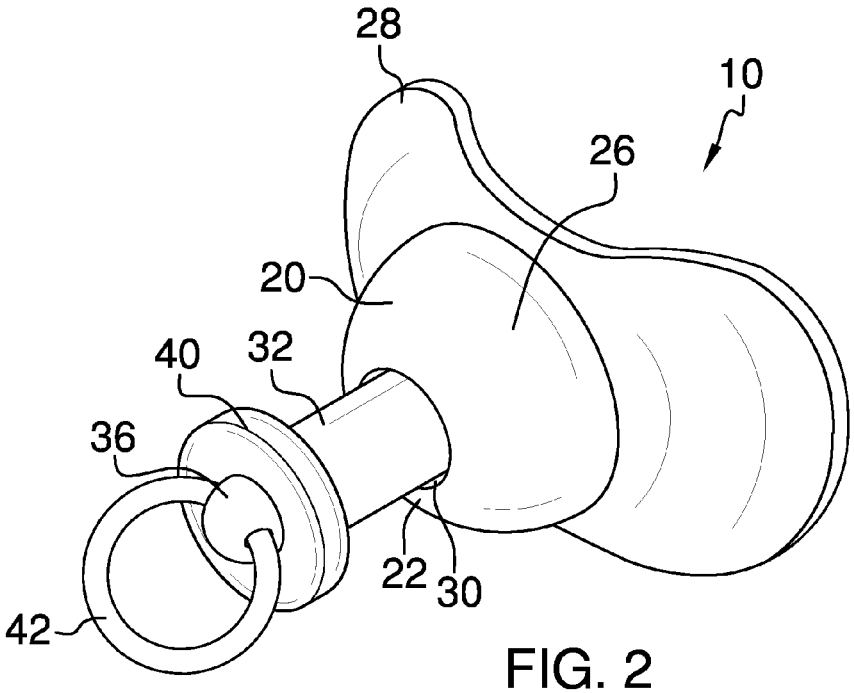
FIG. 2 is an isometric view illustrating the shaft member in a retracted position.
Figure 3:
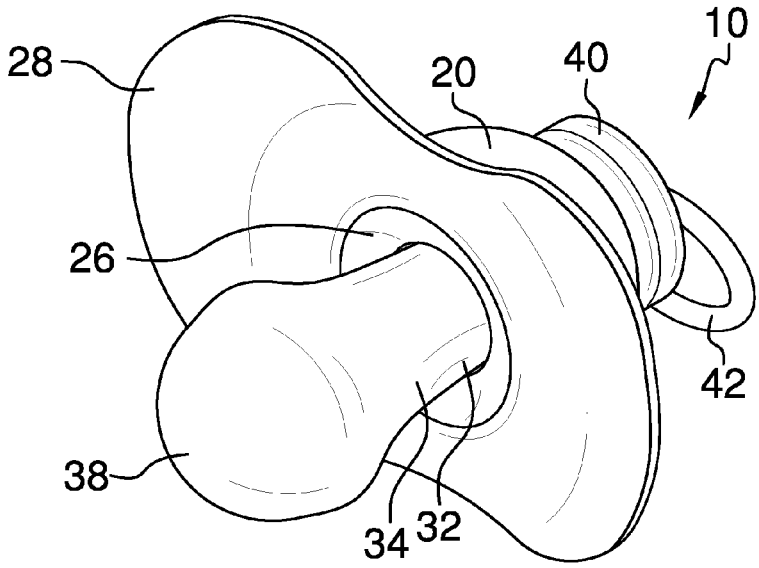
FIG. 3 is an isometric view illustrating a pacifier nipple in the extended position.
Figure 4:
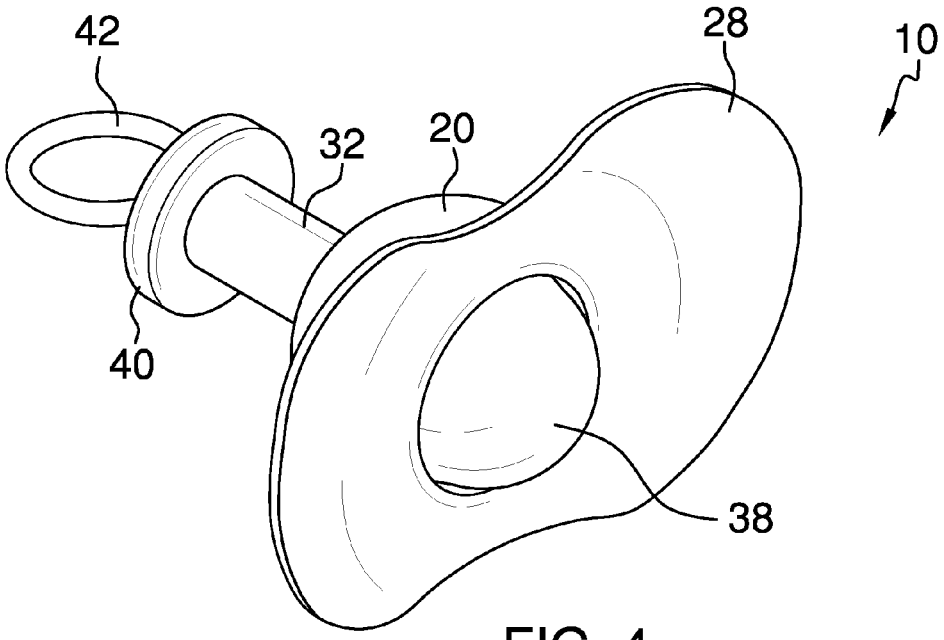
FIG. 4 is an isometric view illustrating the pacifier nipple in the retracted position.
Figure 5:
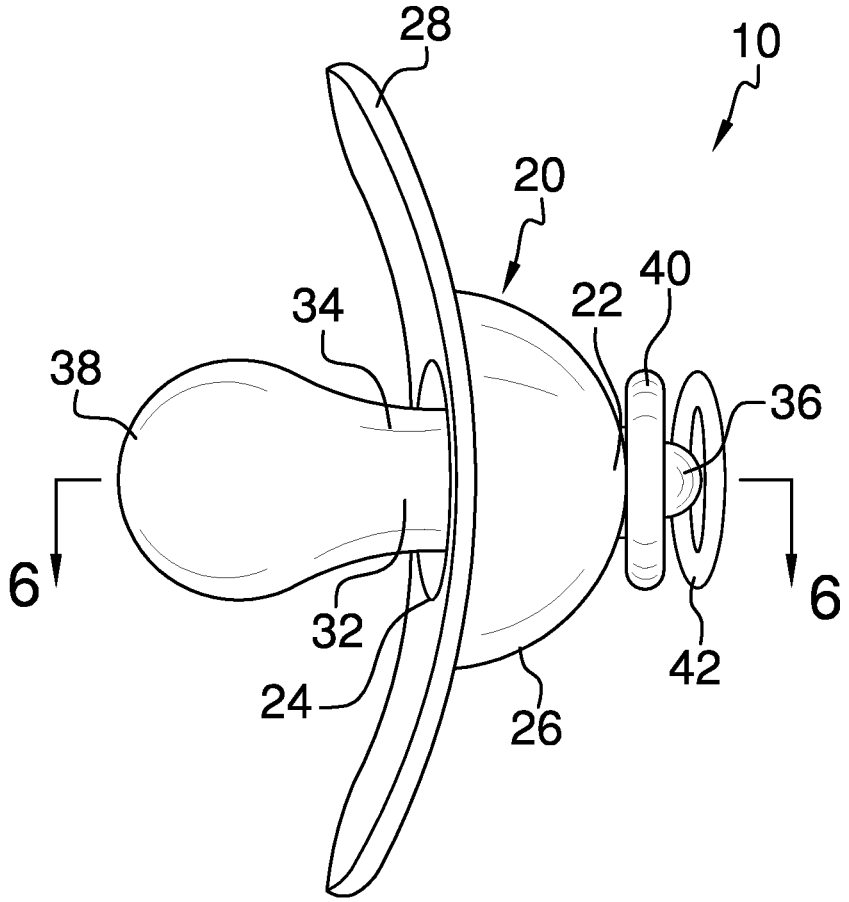
FIG. 5 is a top view.
Figure 6A:
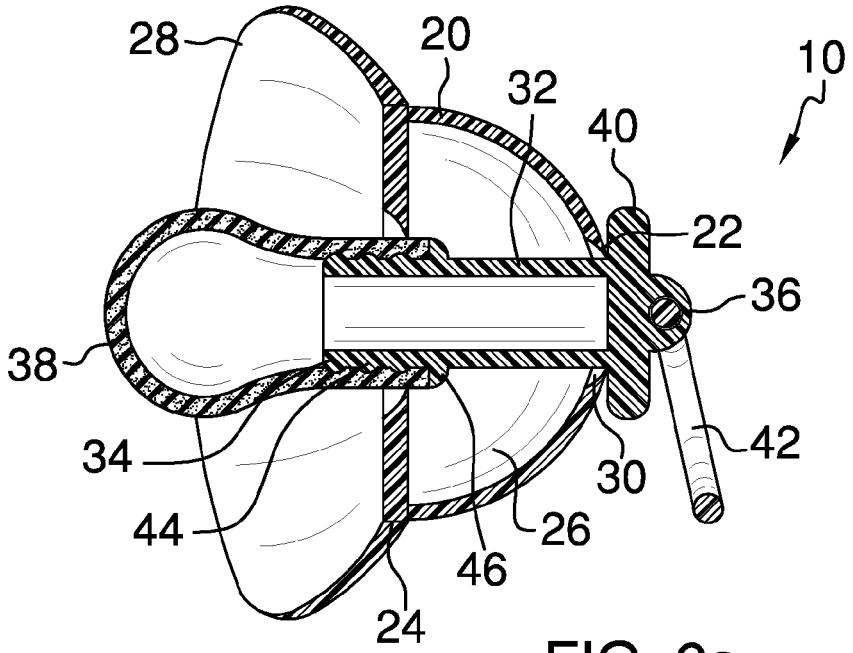
Figure 6B:
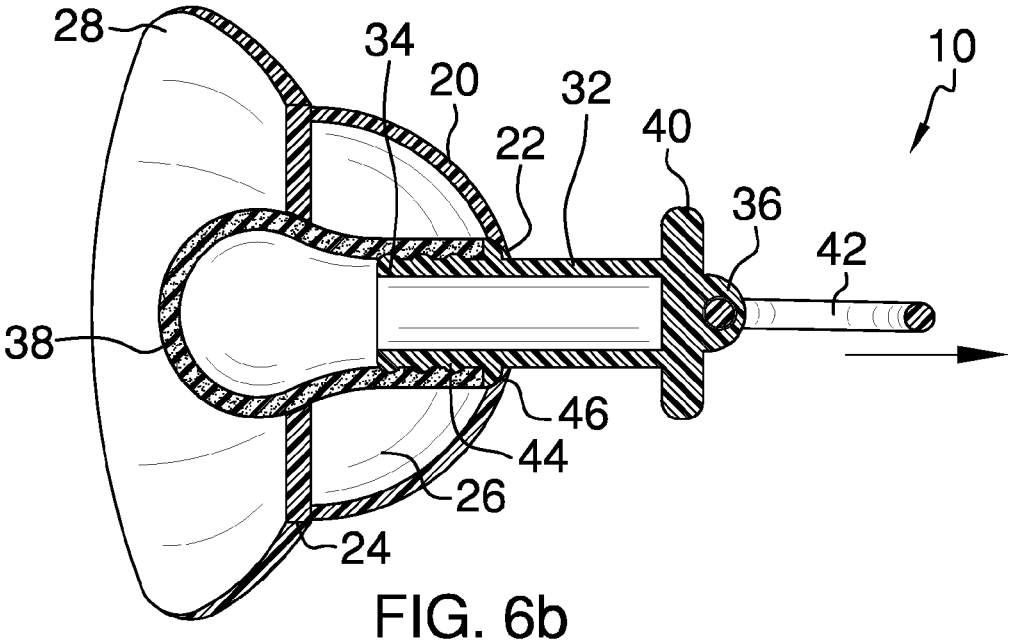

FIG. **6*a* is a cross section view taken along the line 6-6 of FIG. 5**, with the shaft member disposed in the extended position.

FIG. **6*b* is a cross section view taken along the line 6-6 of FIG. 5** with the shaft member disposed in the retracted position.

DETAILED DESCRIPTION OF THE DRAWINGS

With reference now to the drawings, and in particular FIGS. 1 through 6 thereof, example of the instant pacifier with retractable nipple employing the principles and concepts of the present pacifier with retractable nipple and generally designated by the reference number 10 will be described.

Referring to FIGS. 1 through 6 a preferred embodiment of the present pacifier with retractable nipple 10 is illustrated.

The present pacifier with retractable nipple 10 has been devised to offer parents an expedient means of removing a pacifier from a suckling child, and also expediently present said child with said pacifier nipple 38 when desired, while maintaining the pacifier nipple 38 free from contact with additional surfaces, objects, or other items against which a pacifier nipple 38 may otherwise contact if not disposed retractably within a cup member 20 concavity 26, as will be subsequently described herein.

The present pacifier with retractable nipple 10, therefore, includes a cup member 20 having an apex 22 and a rim 24 disposed around a concavity 26. A winged periphery 28 is attached extending from the rim 24 and presents a surface disposed to contact the face, proximal and surrounding the mouth of a child suckling upon the present pacifier with retractable nipple 10. The winged periphery 28 also prevents the pacifier with retractable nipple 10 from rolling when placed appropriately upon a surface between uses and thus aids in preventing contamination of the device 10.

An aperture 30 is disposed in the apex 22 of the cup member 20, through which a shaft member 32 is slidably disposed. The shaft member 32 includes a first end 34 and a second end 36 and is moveable through the apex 22 between an extended position and a retracted position.

A pacifier nipple 38 is disposed endwise upon the shaft member 32 first end 34, said pacifier nipple 38 configured to fit within the concavity 26 when the shaft member 32 is moved to the retracted position, and also extend from within the concavity 26 when said shaft member 32 is moved to the extended position. Thus, movement of the shaft member 32 between the extended and retracted positions alternately extends the pacifier nipple 38 for use and retracts the pacifier nipple 38 into the cup concavity 26.

The pacifier nipple 38 is threadably disposed upon the first end of the shaft member 32, and is therefore replaceable, as desired. The first end 34 of the shaft member 32 therefore includes a threaded section 44 and a lip member 46 disposed circumferentially around the shaft member 32. The threaded section 44 is thus disposed between the first end 34 and the lip member 46. The lip member 46 also prevents overextension of the shaft member 32 when moved to the retracted position by abutting the cup member 20 proximal the aperture 30 disposed in the apex 22.

To prevent overextension of the shaft member 32 when moved to the extended position, a discoid stopper member 40 is disposed circumferentially upon the shaft member proximal a second end 36. The stopper member 40 is there disposed to engage against the cup member 20 apex 22 when the shaft member 32 is moved to the extended position and prevents the shaft member 32 from overextension whereby injury to a child could be accidentally effected.

To enable expedient wielding of the shaft member 32, and thus selective movement of the shaft member 32 between the extended and retracted positions, a ring member 42 is disposed through the shaft member 32 second end 36. The shaft member 32 is thereby readily manipulated when a parent (or other person, as case may be) grasps the ring member 42.

Thus, the pacifier nipple 38 is readily extendible for use and retractable into the concavity 26 of the cup member 20 when the ring member 42 is pulled, whereby the pacifier with retractable nipple 10 is readily removable from a suckling child and the pacifier nipple 38 is storable in the retracted position, there less likely to be contaminated by contact with extant objects, surfaces, or other contaminants prevalent in, upon, and around the ambient environment wherein said pacifier with retractable nipple 10 may be stored between uses.

What is claimed is:

1. A pacifier with retractable nipple comprising:

a cup member having an apex and a rim disposed around a concavity;

an aperture disposed in the apex;

a shaft member slidably disposed through the apex, said shaft member having a first end and a second end moveable between an extended position and a retracted position;

a pacifier nipple disposed endwise upon the shaft member first end, said pacifier nipple disposed to fit within the concavity when the shaft member is moved to the retracted position, and extend from the concavity when said shaft member is moved to the extended position;

wherein the pacifier nipple is extendible for use and retractable into the concavity of the cup member when a ring member is pulled;

a winged periphery attached extending from the rim, said winged periphery disposed to surround the mouth of a person using the pacifier with retractable nipple; and a discoid stopper member disposed upon the shaft member proximal the second end, said stopper member disposed to engage against the cup member apex when the shaft member is moved to the extended position;

wherein a lip member is disposed upon the shaft member more proximal the first end, said lip member disposed to abut the apex of the CUP member when the shaft member is moved to the retracted position preventing overextension of the shaft member is prevented when said shaft member is moved to the retracted position; and wherein the pacifier nipple is threadably attached to the shaft member first end; wherein the shaft member includes a threaded section disposed between the first end and the lip member to which the pacifier nipple threadably and securely attaches; and further comprising a ring member disposed through the shaft member second end, said ring member disposed to enable grasping and movement of the shaft member between the extended and the retracted position.

2. A pacifier with retractable nipple comprising:

a cup member having an apex and a rim disposed around a concavity;

a winged periphery attached extending from the rim;

an aperture disposed in the apex;

a shaft member slidably disposed through the apex, said shaft member having a first end and a second end moveable between an extended position and a retracted position;

a lip member disposed circumferentially upon the shaft member more proximal the first end, said lip member disposed to abut the apex when the shaft member is moved to the retracted position;

a threaded section disposed upon the shaft member between the first end and the lip member;

a pacifier nipple threadably attachable to the threaded section of shaft member, said pacifier nipple disposed to fit within the concavity when the shaft member is moved to the retracted position, and extend from the concavity when said shaft member is moved to the extended position;

a discoid stopper member disposed upon the shaft member proximal the second end, said stopper member disposed to engage against the cup member apex when the shaft member is moved to the extended position;

a ring member disposed through the shaft member second end;

wherein the winged periphery is disposed to overlie and surround the mouth of a person using the pacifier with retractable nipple, the pacifier nipple is extendible for use and retractable into the concavity of the cup member when the ring member is pulled, whereby the pacifier with retractable nipple is readily presentable to, and removable from, a suckling child while maintaining the pacifier nipple excluded from the ambient environment when stored in the retracted position.

* * * * *